US009138021B2

(12) United States Patent
Mardirosian

(10) Patent No.: US 9,138,021 B2
(45) Date of Patent: Sep. 22, 2015

(54) SCARF

(76) Inventor: Susanne Mardirosian, Riverside, CA (US)

( * ) Notice: Subject to any disclaimer, the term of this patent is extended or adjusted under 35 U.S.C. 154(b) by 297 days.

(21) Appl. No.: 13/527,403

(22) Filed: Jun. 19, 2012

(65) Prior Publication Data

US 2013/0334270 A1 Dec. 19, 2013

(51) Int. Cl.

*A41D 23/00* (2006.01)
*A45F 3/00* (2006.01)
*A41D 27/20* (2006.01)

(52) U.S. Cl.

CPC ..... *A41D 23/00* (2013.01); *A41D 27/20* (2013.01); *A45F 2003/002* (2013.01)

(58) Field of Classification Search

USPC ..... 224/602, 576, 182, 587, 600, 601, 623, 224/255; 2/207, 66, 91, 129, 173, 202, 203, 2/206

See application file for complete search history.

(56) References Cited

U.S. PATENT DOCUMENTS

| | | | | |
|---|---|---|---|---|
| 3,206,765 | A * | 9/1965 | Sherman | 2/144 |
| 4,843,644 | A * | 7/1989 | Sugarman | 2/46 |
| 4,949,887 | A * | 8/1990 | Holmes | 224/577 |
| 5,836,670 | A * | 11/1998 | Gilson | 362/103 |
| 5,927,842 | A * | 7/1999 | Preisler | 362/103 |
| 6,266,823 | B1 * | 7/2001 | Padoan | 2/144 |
| 8,549,662 | B2 * | 10/2013 | Chang | 2/9 |
| 2012/0042432 | A1 * | 2/2012 | Tawfik | 2/66 |
| 2013/0048687 | A1 * | 2/2013 | Do | 224/222 |

* cited by examiner

*Primary Examiner* — Justin Larson
*Assistant Examiner* — Phillip Schmidt
(74) *Attorney, Agent, or Firm* — Lawrence S. Cohen

(57) ABSTRACT

A scarf for wearing around the neck, provides a hidden pocket that is readily accessible to the wearer and that can hold a detachable purse. The scarf is formed of a piece of soft and heavy fabric sewn into the form of a tube with a tube centerline that extends 360° around the wearer's neck. The front of the tube drapes in a plurality of folds on the chest of the wearer to conceal a slit in the tube that can be zipped open and through which the wearer has access to the inside of the tube. To encourage the scarf to lie in multiple folds on the chest, the tube has a taller front end than rear end.

7 Claims, 2 Drawing Sheets

FIG. 1
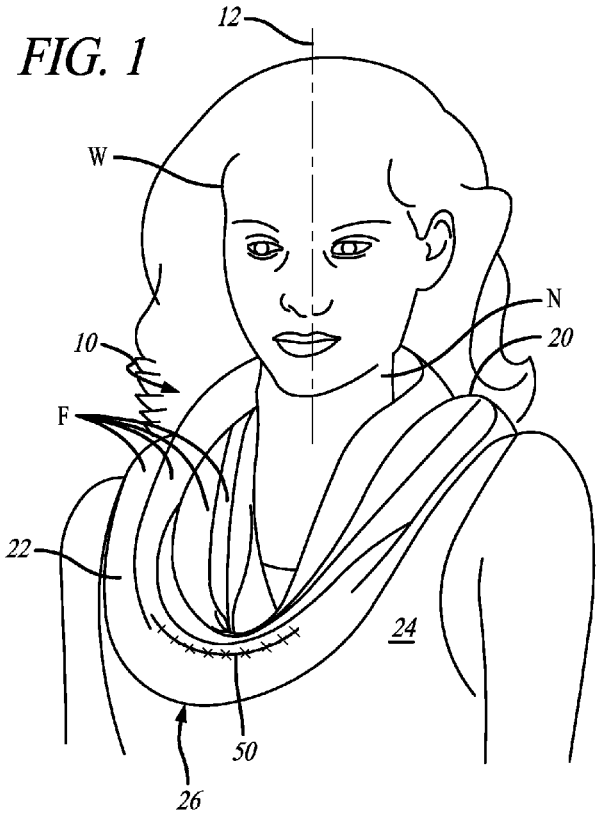
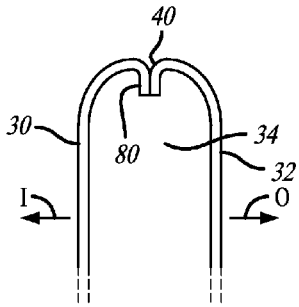
FIG. 5
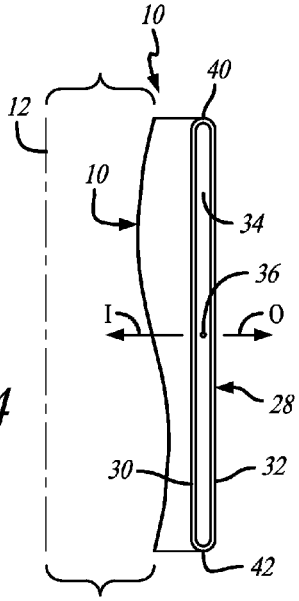
FIG. 4
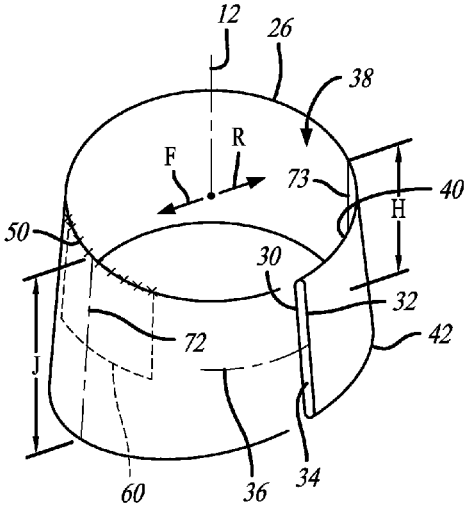
FIG. 2
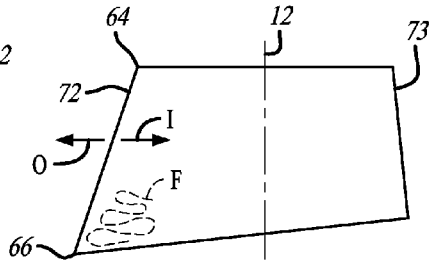
FIG. 3

SCARF

BACKGROUND OF THE INVENTION

Women's clothes generally do not have pockets in which valuables such as a wallet or passport can be securely stored. It is common for a woman to store valuable in a purse that is hand-held or held by a chain about a woman's neck. However, the purse can be laid down and forgotten or stolen, and a chain around the neck to hold a purse can be uncomfortable and calls attention to the location of valuables.

SUMMARY OF THE INVENTION

In accordance with one embodiment of the invention, a storage device is provided that holds valuables in a place that is hidden and difficult for a thief to gain access to, and that allows the wearer to "keep an eye" on that storage device to assure her that the valuables are safe. The device is in the form of a scarf that is worn about the neck. The scarf is formed of soft, flexible, and usually nonelastic fabric that forms a flat closed tube with a centerline that extends 360° around a vertical axis that is aligned with the wearer's neck. The tube has a horizontal slit of about one foot length, with a zipper that closes the slit but allows easy opening for access to the inside of the tube. A purse may be hung on the inside of the tube, with the purse being detachable.

The front of the tube is tall as well as soft and heavy, which results in the tube lying in multiple folds on the chest of the wearer. This makes it difficult for another person to see the slit or see that valuables are being stored in the storage device.

The novel features of the invention are set forth with particularity in the appended claims. The invention will be best understood from the following description when read in conjunction with the accompanying drawings.

BRIEF DESCRIPTION OF THE DRAWINGS

FIG. 1 is an isometric view of a woman wearing a storage device of the invention.

FIG. 2 is an isometric view of the storage device of FIG. 1, but with the walls of the device shown extending straight and primarily vertical.

FIG. 3 is a side elevation view of the device of FIG. 2, with the tube walls shown straight.

FIG. 4 is a sectional view of the tube of FIG. 2.

FIG. 5 is a sectional view of the upper portion of the device of FIG. 2, at a seam of the device.

DESCRIPTION OF THE INVENTION

Figure 6:
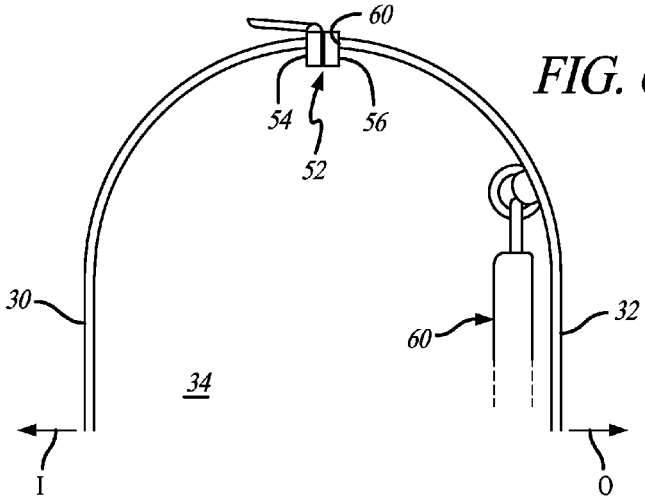
FIG. 6 is a sectional view of the upper portion of the device, at a slit and zipper therein, and showing a detachable purse.

FIG. 1 shows a storage device 10 in the form of a scarf, being worn by a woman W. The scarf extends 360° around a vertical axis 12 that passes through the neck N of the upright standing woman. The scarf has a rear portion 20 that drapes onto the back of the woman. The scarf is formed from a piece of fabric 26 and has a front portion 22 that drapes onto the chest or bosom 24 of the woman in a plurality of folds F. FIG. 2 shows the storage device as it would look if its walls were rigid and straight instead of flexible and curved. The piece of fabric that forms the scarf can be held in the shape of a tube 28

(FIG. 4) with inner and outer walls 30, 32 lying respectively closest and furthest from the vertical axis 12, to form a flat tube. The tube forms a pocket 34 between the inner and outer walls. The tube has a centerline 36 that extends 360° around the vertical axis, and there is a large vertical hole 38 (FIG. 2) in the center of the scarf. The top 40 and bottom 42 of the tube merge into each other.

FIG. 2 shows that the tube has a horizontal slit 50 of a length of a plurality of inches, such as 12 inches, that leads to the pocket 34. As shown in FIG. 6, a zipper 52 has opposite zipper sides 54, 56 that are attached to the opposite sides of the walls of the slit 50, so access to the pocket 34 can be gained by unzipping the zipper. Other zipper means or fasteners can be used such as a hook and loop fastener, for example a Velcro™ fastener. Although large valuables such as a large paper document, can be merely slipped into the pocket of the scarf, smaller valuables such as jewelry and cash can be stored in a purse 60 that is mounted in the pocket. The purse 60 which lies in the pocket formed by the tube, is hidden from view when it is closed and stored. If desired, the purse can be detached from hangers on the pocket walls so the entire purse can be removed from the pocket.

Figure 8:
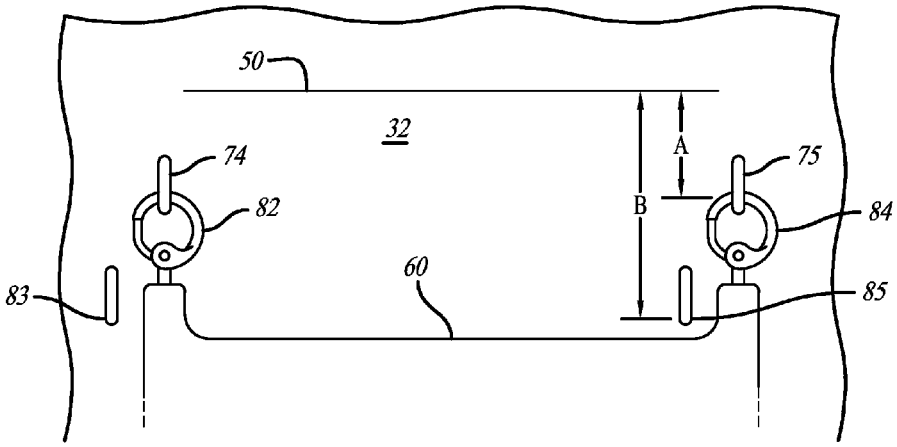
FIG. 8 shows the inside wall of the pocket at, and below the slit.

FIG. 8 shows two high hangers 74, 75 on the tube outer wall 32 below the slit 50, and two low hangers 83, 85. The differences in height B-A equals at least one centimeter and is preferably 1.5 inch. Fasteners 82, 84 can be attached to the high hangers 74, 75 or to the low hangers 83, 85. If the wearer wants the purse 60 to lie high on her chest she chooses the high hangers 74, 75, and if she wants the purse to lie lower she chooses the low hangers 83, 85. The hangers 74, 75 can lie above the level of the slit.

Figure 7:
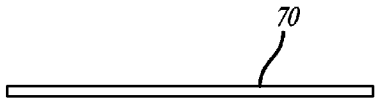
FIG. 7 shows the shape that a piece of cloth would take if not sewn into a tube with a tapered vertical hole.

FIG. 4 shows the scarf 10 with its top 40 and bottom 42 spaced along the vertical axis 12. In actuality, the tube walls would collapse. When the tube walls collapse, they form several folds F (FIG. 3) that lie on one another, with the upper folds lying radially inward I of the lower fold. This is because the location 64 of the top of the front end of the scarf shown in FIG. 3 lies inward I of the bottom at 66 of the scarf front end. Applicant wants to form such folds in order to conceal the slit 50 which lies at 64. If the fabric were in the form of a single sheet, as shown at 70 in FIG. 7, then the fabric would not fall or collapse into a plurality of folds, but would be a flat sheet lying on the woman's chest where any slit in the tube would not be concealed and would be noticeable.

Applicant has made scarfs of the construction shown in the figures. The rear end 73 (FIG. 2) has a height (when vertical) of 33 inches, the front end 72 has a height J of 43 inches. The front end height J is preferably more than 10% greater than the rear end height, and is actually 30% greater. The vertical aperture 38 at the top (when circular) has a diameter of 12 inches, and the aperture has a diameter of 18 inches at the bottom. The purse 60 has a width of 9 inches, and a height of about 5½ inches. The scarf can be formed of a sheet of fabric that is folded along a horizontal line to form the bottom 42 of the tube, and with the upper ends of the sheet sewn together to form the top 40 of the tube. The opposite walls of the tube are sewn together along a joint 80 (FIG. 5) to form the top 40 of the tube. The top ends of the tube are sewn together along a line 80 (FIG. 5) that otherwise would be part of the slit.

Thus, the invention provides a storage device with a pocket that can hold a detachable purse. The walls of the pocket have a slit opening that is concealed and that can be readily monitored by the wearer, while providing easy access by the wearer. The storage device is in the form of a scarf, but is formed of inner and outer layer portions of soft cloth that form an initially flat vertical tube with a tube centerline that extends 360° around a vertical neck axis of the wearer's neck. When placed around the neck, the tube front portion drapes in a plurality of folds onto the chest of the wearer, with the plurality of folds concealing a slit that provides access to the hollow inside of the scarf tube. The scarf tube extends further forward than rearward from the vertical axis, and the front end of the tube is taller than the rear end of the tube, to form more folds at the front than at the rear. The scarf can be worn over the head to protect against rain and sunshine, and can be worn to conceal the face of the wearer.

Although particular embodiments of the invention have been described and illustrated herein, it is recognized that modifications and variations may readily occur to those skilled in the art, and consequently, it is intended that the claims be interpreted to cover such modifications and equivalents.

What is claimed is:

1. A scarf to be worn by a wearer having a neck a chest and a back comprising:

the scarf being formed from a piece of soft fabric that forms a flat tube that extends 360° about a vertical axis to encircle the neck of the wearer, said flat tube having radially inner and outer layers that merge into each other to form said tube;

said tube having front and rear portions with said front portion having a height that is greater than a height of said rear portion and said tube having a top and a bottom spaced along the vertical axis and the top of the front portion of the scarf lies inward of the bottom of the front portion of the scarf so that more of said soft fabric will drape onto the chest of the wearer than onto the wearer's back;

said tube being closed to form a closed pocket that extends 360 degrees around the neck between the inner and outer layers except for having a slit which lies along the top of the front portion with a slit length of a plurality of inches, and including slit fasteners at opposite edges of said slit that can be fastened together to close said slit; and a purse lying in said tube below said slit and being attachable by hangars attached inside the tube to fasteners on the purse.

2. The scarf described in claim 1 wherein:

said scarf is formed from a piece of fabric folded to form said bottom of said tube and said inner and outer layers, said inner and outer layers being joined together thereby forming said closed pocket except along said slit.

3. The scarf of claim 1 wherein the slit fasteners define a zipper.

4. A scarf worn on a person having a neck and a chest, around the person's neck vertical axis, comprising:

a piece of fabric folded into two layers and into a closed tube with a tube centerline that extends around the vertical axis of the person's neck, said two layers forming radially inner and outer tube walls said tube having a continuous hollow interior;

said tube has front and rear ends that lie respectively on the person's chest and behind the person's neck, said front end having a greater height than said rear end so more of said scarf can drape on the person's chest than on the person's back;

said tube having a horizontal slit of a length of a plurality of inches and having a zipper on said slit to allow said slit to be opened and closed;

a purse lying inside said tube, a pair of fasteners on said purse that attach an upper portion of the purse to an inner surface of one of said inner or outer tube walls so when the slit is opened the wearer has access to the purse.

5. The scarf of claim 4 wherein the pair of fasteners attach to corresponding hangers on said one of said inner or outer tube walls.

6. The scarf of claim 5 wherein the corresponding hangers are on the inner tube wall.

7. The scarf of claim 4 wherein the purse is attached to the inner tube wall.

* * * * *